US008627978B2

(12) United States Patent
Nishibe et al.

(10) Patent No.: US 8,627,978 B2
(45) Date of Patent: Jan. 14, 2014

(54) EASY-OPEN CAN END, METHOD FOR MANUFACTURING CAN END, AND BEVERAGE PRODUCT FILLED IN CAN CONTAINER USING THE SAME

(75) Inventors: Tadashi Nishibe, Tokyo (JP); Takahiko Okada, Tokyo (JP)

(73) Assignee: Kirin Beer Kabushiki Kaisha, Tokyo (JP)

( * ) Notice: Subject to any disclaimer, the term of this patent is extended or adjusted under 35 U.S.C. 154(b) by 945 days.

(21) Appl. No.: 12/667,774

(22) PCT Filed: Jul. 1, 2008

(86) PCT No.: PCT/JP2008/061887

§ 371 (c)(1),
(2), (4) Date: Jan. 5, 2010

(87) PCT Pub. No.: WO2009/005050

PCT Pub. Date: Jan. 8, 2009

(65) Prior Publication Data

US 2010/0326281 A1 Dec. 30, 2010

(30) Foreign Application Priority Data

Jul. 5, 2007 (JP) ..... 2007-177701

(51) Int. Cl.
*B65D 17/34* (2006.01)
*B21D 51/44* (2006.01)

(52) U.S. Cl.
USPC ..... 220/269; 220/906; 413/16

(58) Field of Classification Search
USPC ..... 220/269, 906; 413/12, 14, 16
See application file for complete search history.

(56) References Cited

U.S. PATENT DOCUMENTS

| | | | | |
|---|---|---|---|---|
| 5,813,561 | A | 9/1998 | Chang et al. | |
| 7,168,586 | B2 | 1/2007 | Jeon | |
| 2002/0088804 | A1 | 7/2002 | Omura | |
| 2005/0252917 | A1 * | 11/2005 | Turner et al. | 220/269 |
| 2007/0039961 | A1 * | 2/2007 | McEldowney et al. | 220/269 |

FOREIGN PATENT DOCUMENTS

| | | | |
|---|---|---|---|
| JP | 56166231 | U | 12/1981 |
| JP | 03111939 | U | 11/1991 |
| JP | 08006746 | U | 2/1996 |
| JP | 2002514993 | A | 5/2002 |
| JP | 2002172445 | A | 6/2002 |
| JP | 2002362553 | A | 12/2002 |
| WO | 9838100 | A | 9/1998 |

* cited by examiner

*Primary Examiner* — Anthony Stashick
*Assistant Examiner* — James N Smalley
(74) *Attorney, Agent, or Firm* — Sughrue Mion, PLLC

(57) ABSTRACT

An easy-open can end including an inclined surface formed in a direction of a tab tail of a pull-tab from a center of a panel such that the center of the panel becomes a maximum concave portion, a lower surface of the pull-tab abuts on the inclined surface or is brought close to the inclined surface along the inclined surface, the pull-tab has a pit S formed by pressing-down forming, and the pull-tab is bent by the pit S. A method for manufacturing an easy-open can end including a process for pressing down part of an outer rim of the pull-tab after or at the same time as a process for fixing the pull-tab to the panel.

5 Claims, 6 Drawing Sheets

PRIOR ART

EASY-OPEN CAN END, METHOD FOR MANUFACTURING CAN END, AND BEVERAGE PRODUCT FILLED IN CAN CONTAINER USING THE SAME

CROSS-REFERENCE TO PRIOR APPLICATIONS

This is the U.S. National Phase Application under 35 U.S.C. §371 of International Patent Application No. PCT/JP2008/061887 filed Jul. 1, 2008, which claims the benefit of Japanese Patent Application No. 2007-177701 filed Jul. 5, 2007, both of which are incorporated by reference herein. The International Application was published in Japanese on Jan. 8, 2009 as WO 2009/005050 A1 under PCT Article 21(2).

FIELD

The present invention relates to a can end including an easy-open mechanism for sealing a can container, more particularly to a can end suitable to a beverage can container, a can end manufacturing method, and a beverage product using the same.

BACKGROUND

In the can container typified by a beverage can filled with liquid contents, the can end including a pull-tab that easily open the can is frequently used as the easy-open mechanism. FIG. 1 is a front view illustrating an example of the easy-open can end including the pull-tab, and FIG. 2 is a longitudinal sectional view of the easy-open can end. A pull-tab 7 is attached to a can end 1 by a rivet 5. When a tab tail 15 of the pull-tab 7 is pulled up while caught with a finger, the neighborhood of the rivet 5 is bent to become a fulcrum, and a leading end of a nose portion 13 of the pull-tab 7 becomes a point of action to push down a score panel 19 that is of a portion surrounded by a score 17 (notch line for guiding rip-opening of can end) in a surface of a panel 3. As a result, the surface of the panel 3 is rip-opened along a shape of the score 17, and the score panel 19 is pressed into the can without leaving from a can end 1 to open the can. At this point, because a faucet is opened, "can opening" is called "opening".

In the easy-open can end, at the beginning of a can opening operation, it is typical to insert a finger into a gap between the panel 3 and the tab tail 15 of the pull-tab 7 to pull up the pull-tab 7. At the beginning of the can opening operation, it is typical that the pull-tab 7 be pulled up with a large force in order to initially rupture the score 17. Therefore, it is preferable to improve ease of catching of the pull-tab 7 with a finger (hereinafter also referred to as "finger catching property (finger access)") in order to enhance a can opening property. Conventionally, as illustrated in FIGS. 1 and 2, in order to improve the finger catching property, a recess called a finger deboss 21 is provided in the panel 3 near the tab tail 15 of the pull-tab 7 such that the finger goes around to the under side of the tab tail 15. However, the finger catching property is insufficiently improved, because the finger deboss 21 cannot sufficiently largely be formed according to a finger size from the viewpoints of restriction of a surface space of the panel 3 and preservation of the strength of the can end. Therefore, there have been proposed following methods in order to improve the finger catching property.

That is, the method in which projection is provided in an upper surface of the panel 3, which is in contact with a lower surface of the pull-tab 7, and the method for previously bending the pull-tab 7 are described as the method for uplifting the tab tail 15 from the panel 3 only by a necessary amount in order to spread a gap between the tab tail 15 of the pull-tab 7 and the panel 3 to easily catch the tab tail 15 with the finger (for example, see Japanese Utility Model Publication No. 8-6746). There has also been proposed a method for easily catching the tab tail 15 with the finger by previously providing the a low-strength portion in an outer rim 11 (outside portion of a U-shape notch portion 9 of the pull-tab) of the pull-tab 7 such that the pull-tab 7 is bent by a predetermined amount with a small force to lift the tab tail 15 at the beginning of the can opening operation (for example, see Japanese Utility Model Publication Laid-Open No. 3-111939).

SUMMARY

However, when the tab tail of the pull-tab is largely uplifted from the panel 3 in order to ensure the gap enough to catch the tab tail with the finger, the uplifted tab tail comes into contact with the backside (inner surface side of the can) of the panel of the upwardly stacked can end in conveying the stacked can ends or retaining the can end during a process for manufacturing the can end or a process for seaming the can container. Therefore, unfortunately the can ends interfere with each other to damage a film of paint in the backside of the panel, or a gap is generated in the stack of the can ends to degrade the stacking property, which results in a conveyance defect. It is difficult to sufficiently improve the finger catching property (hereinafter the property in which the pull-tabs of the can ends are stably stacked without coming into contact with the upper-side can end in stacking the can ends is referred to as "stacking property of can end"). On the other hand, for the finger catching property improving method in which the pull-tab is bent in opening the can, it is difficult to bend the pull-tab by the predetermined amount, and it is also difficult to ensure the strength necessary for the pull-tab.

An aspect of the present invention is to improve the finger catching property of the pull-tab in the easy-open can end. Specifically, an aspect of the present invention is to provide the easy-open can end in which the tab tail of the pull-tab is sufficiently uplifted from the can end to improve the finger catching property when the can is used as the can container after the can end is seamed while the strength of the pull-tab is maintained without degrading the stacking property of the can end. Another aspect of the present invention is to provide a method for being able to simply mass-manufacture the easy-open can end. Still another aspect of the present invention is to provide an easily-opened beverage product in which the can container sealed by the easy-open can end is used.

As illustrated in FIG. 2, in the conventional, general easy-open can end 1, the panel 3 is substantially horizontally molded, and the pull-tab 7 fixed with the rivet 5 is also formed into a flat plate, so that the tab tail 15 abuts on the panel 3 or is brought close to the panel 3 along the panel 3. Accordingly, the gap between the tab tail 15 and the panel 3 is extremely small, and the tab tail 15 is hardly caught with the finger such that sometimes a nail tip of the finger is used even if the finger deboss 21 is provided. Because the panel 3 is convexly swelled as illustrated in FIG. 3, the panel 3 is lifted along with the rivet 5 of the pull-tab 7 to spread an interval X between the tab tail 15 and the panel 3 in the can container (hereinafter referred to as "positive pressure can") in which contents is filled such that the inside of the can container becomes a positive pressure after the can end is seamed. However, in opening the beverage can for beer or carbonated beverage, in which the inside generally becomes the positive pressure, the panel 3 of the conventional can end 1 is swelled small in a usual positive pressure level, and the gap between the tab tail 15 and the panel 3 is spread so small that the finger catching property is insufficiently improved.

The center of the panel of the can end is recessed to incline the panel, and the pull-tab is bent by pressing-down forming to form the can end along the inclined surface of the panel. Therefore, the panel of the can end is convexly upwardly swelled by a pressure of a content liquid in the can container with no influence on the stacking property of the can end when the can is used as the can container after the can end is seamed, and the bent pull-tab is upwardly lifted along with the rivet to spread the interval between the tab tail and the panel than ever before.

An easy-open can end according to an embodiment of the present invention includes a score that is carved into a faucet shape in an upper surface of a panel, an opening piece that is surrounded by the score, and a pull-tab that is fixed to a center in the upper surface of the panel with a rivet interposed therebetween, wherein the opening piece is pushed down to open a can while the score is rip-opened by a nose portion of the pull-tab, an inclined surface is formed such that the center of the panel becomes a maximum concave portion in a direction of a tab tail of the pull-tab from the center of the panel, a lower surface of the pull-tab abuts on or is brought close to the inclined surface along the inclined surface, the pull-tab has a pit in an outer rim, the pit being formed by pressing-down forming, and the pull-tab is bent by the pit.

In the easy-open can end according to an embodiment of the present invention, preferably the outer rim in which the pit is provided has a range sandwiched between two tangential lines, the tangential lines being drawn to an outer circumference of the rivet so as to be orthogonal to a direction from the rivet toward the tab tail. When the pit is provided within the range of the outer rim, the pit is substantially matched with the center of the inclined surface of the panel. Therefore, the bending of the pull-tab is substantially matched with the position of the inclined surface of the panel, and the pull-tab easily follows the panel.

In the easy-open can end according to an embodiment of the present invention, preferably an angle formed between the inclined surface of the panel and a horizontal surface ranges from 1 to 3°. When the angle ranges from 1 to 3°, a risk of generating the problem with the stacking property of the can end is eliminated, and the interval between the tab tail and the panel can sufficiently be spread in upwardly convexly swelling the panel of the can end at the point of use.

In the easy-open can end according to an embodiment of the present invention, preferably the maximum concave portion in the center of the panel has a concave amount of 0.1 to 0.5 mm. When the maximum concave portion has the concave amount of 0.1 to 0.5 mm, a risk of disrupting the stacking property of the can end is eliminated, and the interval between the tab tail and the panel can sufficiently be spread in upwardly convexly swelling the panel of the can end at the point of use.

An easy-open can end manufacturing method according to an embodiment of the present invention includes a process for carving a score into a faucet shape in an upper surface of a panel; and a process for fixing a pull-tab to the upper surface of the panel with a rivet interposed therebetween, the rivet being located in center of the panel, wherein part of an outer rim of the pull-tab is pressed down after or at the same time as the process for fixing the pull-tab to the panel.

In the easy-open can end manufacturing method according to an embodiment of the present invention, preferably, in the process for pressing-down forming, an inclined surface is formed by pushing down the center of the panel such that the center of the panel becomes a maximum concave portion with respect to a direction of a tab tail of the pull-tab from the center of the panel, a pit is formed in part of the outer rim of the pull-tab, and the pull-tab is formed such that the pull-tab is bent by the pit to abut on the inclined surface or to bring a lower surface of the pull-tab close to the inclined surface along the inclined surface. While the panel is pushed down and inclined by one-time pressing-down forming, the pull-tab is bent along the inclined surface of the panel. Therefore, the easy-open can end of an embodiment of the present invention can be manufactured simply and efficiently.

A beverage product according to an embodiment of the present invention with which a can container is filled, the can container being sealed by the easy-open can end according to an embodiment of the present invention.

In the easy-open can end of an embodiment of the present invention, the strength of the pull-tab is maintained without degrading the stacking property of the can end, and the tab tail of the pull-tab is sufficiently uplifted from the can end when the can end is used as part of the can container after seamed, so that the finger catching property of the pull-tab can largely be improved. In the easy-open can end manufacturing method of an embodiment of the present invention, the easy-open can end of an embodiment of the present invention can be manufactured simply and efficiently. In the beverage product of an embodiment of the present invention, the can container sealed by the easy-open can end of an embodiment of the present invention is easily opened.

DETAILED DESCRIPTION

Figure 6:
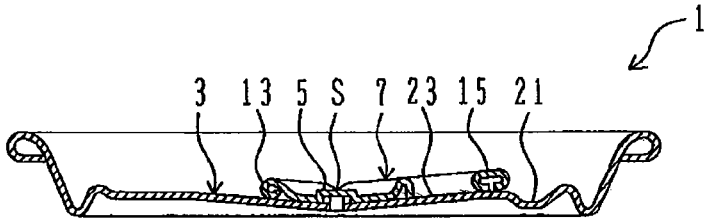
FIG. 6 is a longitudinal sectional view taken on a line B-B' of FIG. 5.

Action of an easy-open can end according to an embodiment of the present invention will be described below. As illustrated in FIG. 6, in the easy-open can end of the embodiment, before the easy-open can end is seamed, an interval between a tab tail 15 and a panel 3 is small to an extent in which the can end stacking property is not degraded. When the easy-open can end is used to seal the positive pressure can, as illustrated in FIG. 4, a panel 3 is convexly swelled, and the swelling extent of the panel 3 is similar to that of the conventional easy-open can end (see FIG. 3) in which the panel 3 is not inclined. At this point, the pull-tab 7 fixed to the rivet 5 is also uplifted along with the rivet 5, and the gap between the tab tail 15 and the panel 3 is spread to form an interval X. The pull-tab 7 of the embodiment is upwardly bent along the inclined surface of the panel 3 into a dog-leg shape (<-shape) that is of the shape before the can end 1 is seamed, the interval X becomes the total of a height of the swelling of the panel 3 and a height of the bending of the tab tail 15. As a result, in the can end 1 of the present invention, the interval X between the tab tail 15 and the panel 3 can sufficiently be spread to a level in which the finger catching property is largely improved.

The embodiment of the present invention will be described with reference to FIGS. 4 to 8. The embodiment is described below only by way of example. The present invention is not limited to the embodiment, but various modifications can be made. The same member and region are designated by the same numerals.

Figure 1:
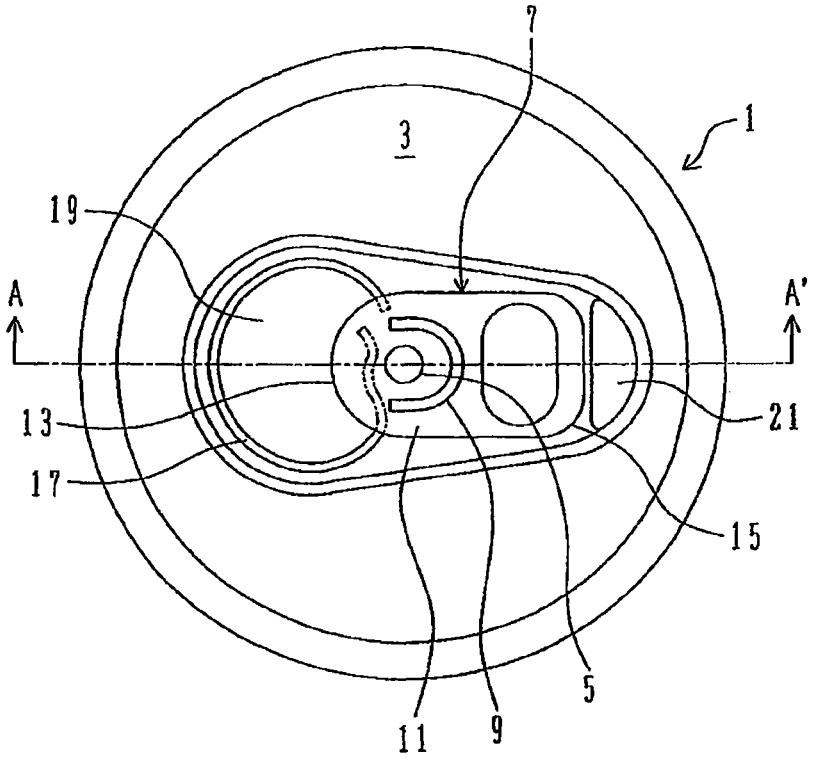
FIG. 1 is a schematic front view illustrating an easy-open can end in a related art.
Figure 2:
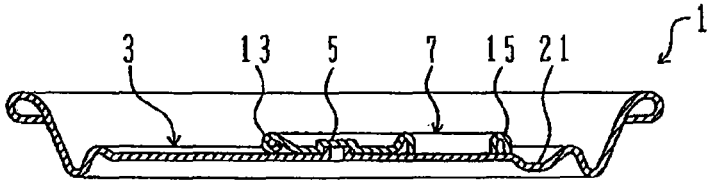
PRIOR ART FIG. 2
FIG. 2 is a longitudinal sectional view taken on a line A-A' of FIG. 1.
Figure 5:
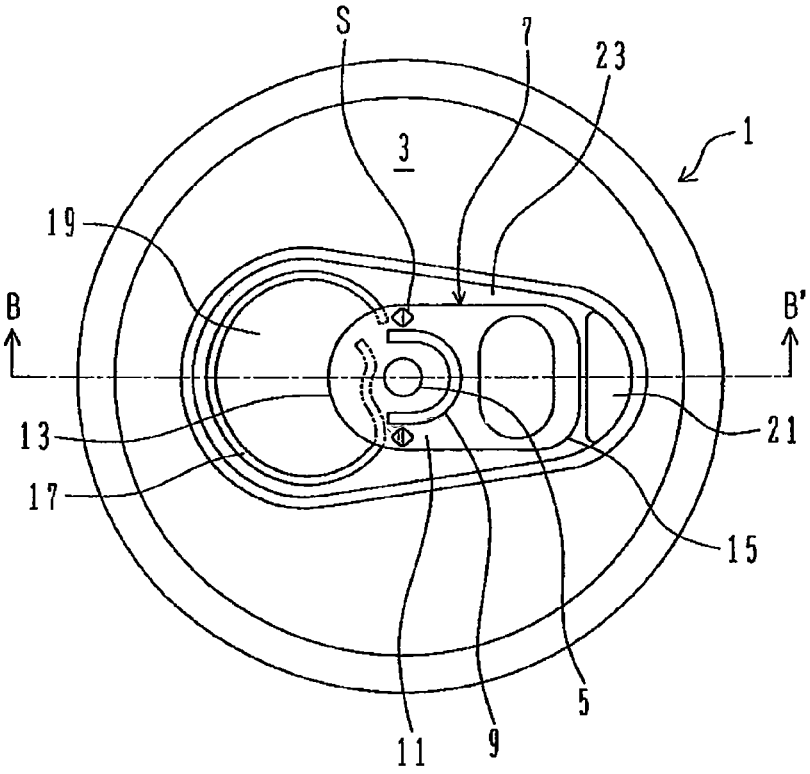
FIG. 5 is a schematic front view illustrating an easy-open can end according to an embodiment of the present invention.

FIG. 5 is a front view illustrating the easy-open can end of the embodiment, and FIG. 6 is a longitudinal sectional view of the easy-open can end (sectional view taken on a line B-B' of FIG. 5). The main components of the easy-open can end 1 of the embodiment are similar to those of the easy-open can end used in liquid can container of FIG. 1. That is, in FIG. 5, the easy-open can end 1 of the embodiment includes the pull-tab 7 that is fixed to the center of the upper surface of the panel 3 with the rivet 5 interposed therebetween, a score 17 that is carved in the upper surface of the panel 3, and an opening piece 19 that is surrounded by the score 17. When the tab tail 15 of the pull-tab 7 is caught with the finger to pull up the pull-tab 7, the opening piece 19 is pushed down by the nose portion 13 of the pull-tab 7, and the score 17 is rip-opened to open the can. In the easy-open can end of the embodiment, as is shown in the sectional shape of FIG. 6, an inclined surface 23 is formed in a direction from the center of the panel 3 toward the tab tail 15 of the pull-tab 7 such that part of the rivet 5 in the center of the panel 3 becomes a maximum concave portion, and a lower surface of the pull-tab 7 abuts on or is brought close to the inclined surface 23 along the inclined surface 23.

The inclined surface 23 formed in the panel 3 may be located within a range where the pull-tab 7 can follows the shape of the inclined surface 23. In FIG. 6, a starting point at which the concavity of the panel 3 is started is set to an end portion of the finger deboss 21 near the tab tail 15. In FIG. 6, the inclined surface 23 is formed into a conical shape with a shallow bottom. Alternatively, the panel maybe recessed into a mortar shape (not illustrated).

In the embodiment, because the pull-tab 7 follows the inclined surface 23 of the panel 3, the pull-tab 7 is bent from the starting point of the neighborhood of the rivet 5 corresponding to the maximum concave portion of the panel 3 with an angle subsequently matched with the inclined angle of the panel 3.

In the embodiment, preferably the interval between the tab tail 15 and the panel 3 ranges from 0 to 0.3 mm. When the tab tail 15 is uplifted more than 0.3 mm, the tab tail 15 comes into contact with the backside of the can end located above in stacking the can ends, and sometimes the stacking property of the can end is possibly degraded.

Figure 7:
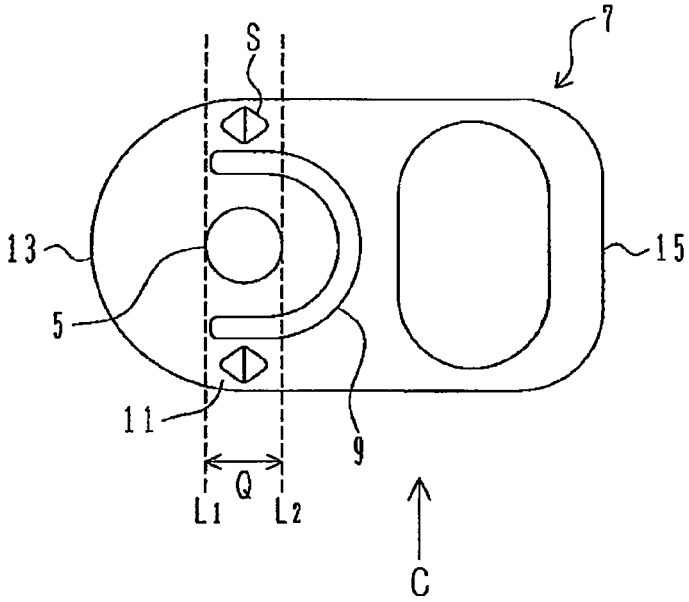
FIG. 7 is a partially enlarged front view illustrating a pull-tab according to an embodiment of the present invention.
Figure 8:
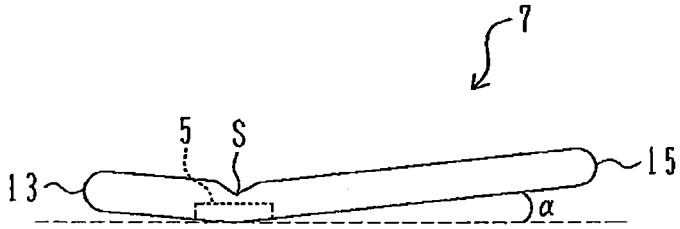
FIG. 8 is a side view illustrating the pull-tab when the pull-tab is viewed from a direction C of FIG. 7.

In the easy-open can end 1 of the embodiment, a pit S is provided in part of an outer rim 11 of the pull-tab 7 by pressing-down forming, thereby bending the pull-tab 7. FIG. 7 is a partially enlarged front view illustrating the pull-tab of the embodiment, and FIG. 8 is a side view illustrating the pull-tab (side view in a direction C of FIG. 7). When the pit S is provided in the outer rim 11 of the pull-tab 7 by the pressing-down forming, because the outer rim 11 has a hollow cylindrical section in which a metallic thin plate is curled, an upwardly bending effect of the pull-tab 7 from the pit S as the starting point is generated by compressing a side surface in the upper portion of the hollow cylinder, so that the pull-tab 7 can easily be bent by a predetermined amount. The control of the pressing-down forming can easily bend the pull-tab 7 to an angle $\alpha$ along the inclined surface of the panel 3 and easily maintain a bending strength of the pull-tab 7.

In the embodiment, desirably the pit S is formed into a wedge shape such that the pull-tab 7 is easy to bend. In the embodiment, desirably the pit S has a depth of 0.05 to 0.1 mm. Sometimes the pull-tab 7 is insufficiently bent when the depth of the pit is lower than 0.05 mm, and sometimes the stacking property of the can end is degraded when the depth of the pit is more than 0.1 mm.

In the embodiment, preferably the pit S is provided in the outer rim 11 in a range sandwiched between two tangential lines L1 and L2 which are drawn in outer circumference of the rivet 5 so as to be orthogonal to a direction from the rivet 5 toward the tab tail 15. When the pit S is provided in the outer rim 11 in the range, as illustrated in FIG. 8, the starting point at which the pull-tab 7 is bent is substantially matched with the maximum concave portion (the point of the rivet 5) of the inclined surface 23 of the panel 3. Therefore, the bending of the pull-tab 7 easily follows the inclined surface 23 of the panel 3.

In an easy-open can end 1 of the embodiment, preferably an angle formed between the inclined surface of the panel 3 and a horizontal surface ranges from 1 to 3°. When the angle is lower than 1°, because the bending amount of the pull-tab 7 which should follow the inclined surface of the panel 3 is decreased, sometimes the interval between the tab tail 15 and the panel 3 can insufficiently be spread in convexly upwardly swelling the panel 3 of the can end 1. Sometimes the stacking property of the can end is degraded when the angle is more than 3°.

In an easy-open can end of the embodiment, preferably the maximum concave portion in the center of the panel 3 has a concave amount of 0.1 to 0.5 mm. When the concave amount is smaller than 0.1 mm, sometimes the interval between the tab tail 15 and the panel 3 can insufficiently be spread in convexly upwardly swelling the panel 3. Sometimes the stacking property of the can end is degraded when the concave amount is more than 0.5 mm.

A representative example of the easy-open can end manufacturing process of the embodiment will be described below. In the can end manufacturing process including a process of carving the score 17 into the faucet shape in the panel 3 and a process of fixing the pull-tab 7 to the center of the panel 3 with the rivet 5, the easy-open can end 1 manufacturing method of the embodiment includes a process of pressing-down part of the outer rim 11 of the pull-tab 7 after the process of fixing the pull-tab 7 to the panel 3. The pressing-down is performed while the pull-tab 7 is fixed to the panel 3, whereby the bending angle $\alpha$ of the pull-tab 7 is easily brought close to the inclined angle of the panel 3. The pressing-down process and the process for fixing the pull-tab 7 to the panel 3 may simultaneously be performed. The riveting and the pressing-down forming can be performed by the one-time pressing process.

The pressing-down forming may be performed by any method as long as the depth of the pit S can be formed to an extent in which the bending strength of the pull-tab 7 is not degraded with respect to the outer rim 11 of the pull-tab 7. However, desirably the pressing-down forming is performed by forming the wedge-shaped recess in order to further generate the upwardly bending effect of the pull-tab 7.

In a method for manufacturing the easy-open can end 1 of the embodiment, in the process for pressing-down the pull-tab 7, preferably the center of the panel 3 is simultaneously pressed down, and the bending is performed while the pit S is provided in the outer rim 11 of the pull-tab 7. That is, the center of the panel 3 is pushed down by the process for pressing-down the outer rim 11 of the pull-tab 7, the inclined surface 23 is formed in the direction from the rivet 5 toward the tab tail 15 such that the center of the panel 3 becomes the maximum concave portion, and the pit S is formed in part of the outer rim 11 of the pull-tab 7 to bend the pull-tab 7. Preferably, the pull-tab 7 is formed such that the lower surface of the pull-tab 7 abuts on or is brought close to the inclined surface 23 along the inclined surface 23. When the push-down of the panel 3 and the bending of the pull-tab 7 are simultaneously performed by the one-time pressing-down forming, the pull-tab 7 is bent along the inclined surface 23 of the panel 3, and the bending angle $\alpha$ of the pull-tab 7 can be brought close to the inclined angle of the panel 3. Therefore, the uplifting amount of the tab tail 15 does not degrade the stacking property of the can end, and the easy-open can end of the embodiment can be manufactured simply and efficiently.

In the can container sealed by the easy-open can end of the embodiment, no problem is generated in the can manufacturing or the filling and seaming process, and the finger catching property is improved to easily open the can. Therefore, the can container sealed by the easy-open can end of the embodiment can suitably used as the container for beverage product.

EXAMPLE

The tab tail uplifting amount that becomes an index for evaluating the finger catching property after the easy-open can end is seamed is investigated as an example for the easy-open can end having the shape of FIGS. 5 and 6.

<Method for Investigating Tab Tail Uplifting Amount>

Figure 3:
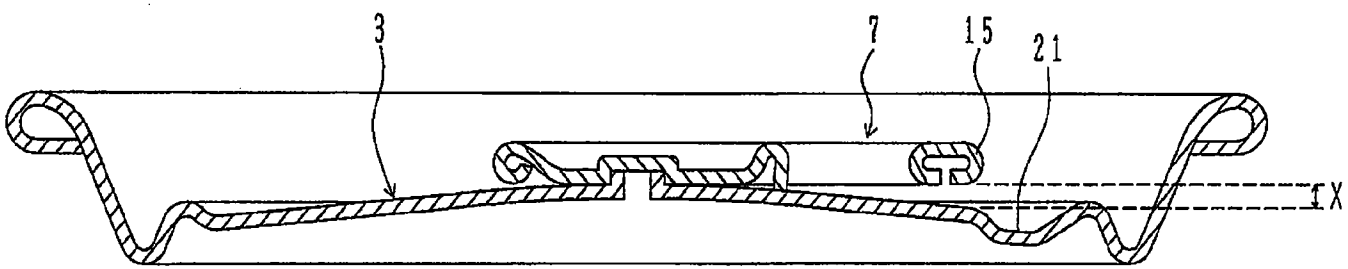
FIG. 3 is a sectional view for explaining a state in which the easy-open can end in the related art is seamed in a positive pressure can.
Figure 4:
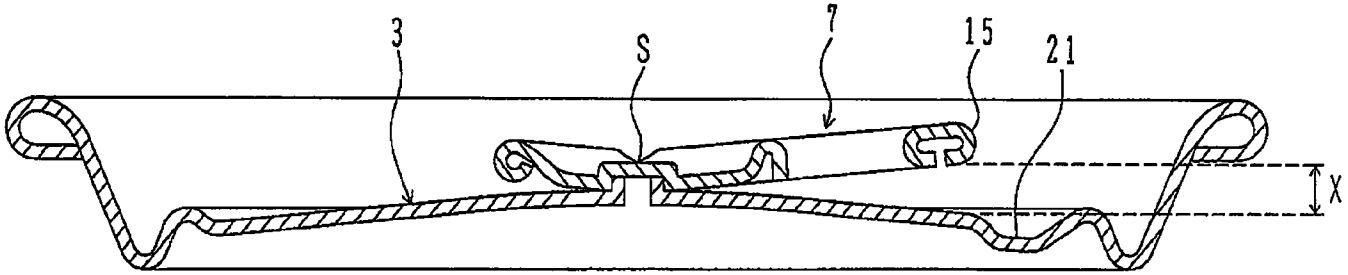
FIG. 4 is a sectional view for explaining a state in which an easy-open can end according to an embodiment of the present invention is seamed in the positive pressure can.

As illustrated in FIGS. 3 and 4, the interval X between the lower surface of the tab tail 15 and the end portion on the side of the tab tail 15 of the finger deboss 21 is measured as the tab tail uplifting amount. In the measurement, a can internal pressure is changed from 0 MPa to 0.5 MPa by 0.05 MPa, and the change in tab tail uplifting amount of the can end is measured after the can end is seamed.

Example

As illustrated in FIGS. 5 and 6, in the easy-open can end (204) made of an aluminum alloy for beer, part of the outer rim 11 of the pull-tab 7 is pressed down with the wedge-shape press to provide the pit, the inclination of 2° is provided in the direction of the finger deboss while the center of the panel 3 becomes the maximum concave portion, and the pull-tab 7 is bent along the inclined surface of the panel 3.

Comparative Example

A comparative example is similar to the example 1 except that the inclination of the panel and the bending of the pull-tab are eliminated while the pressing-down forming is not performed.

<Result of Investigating Tab Tail Uplifting Amount>

Figure 9:
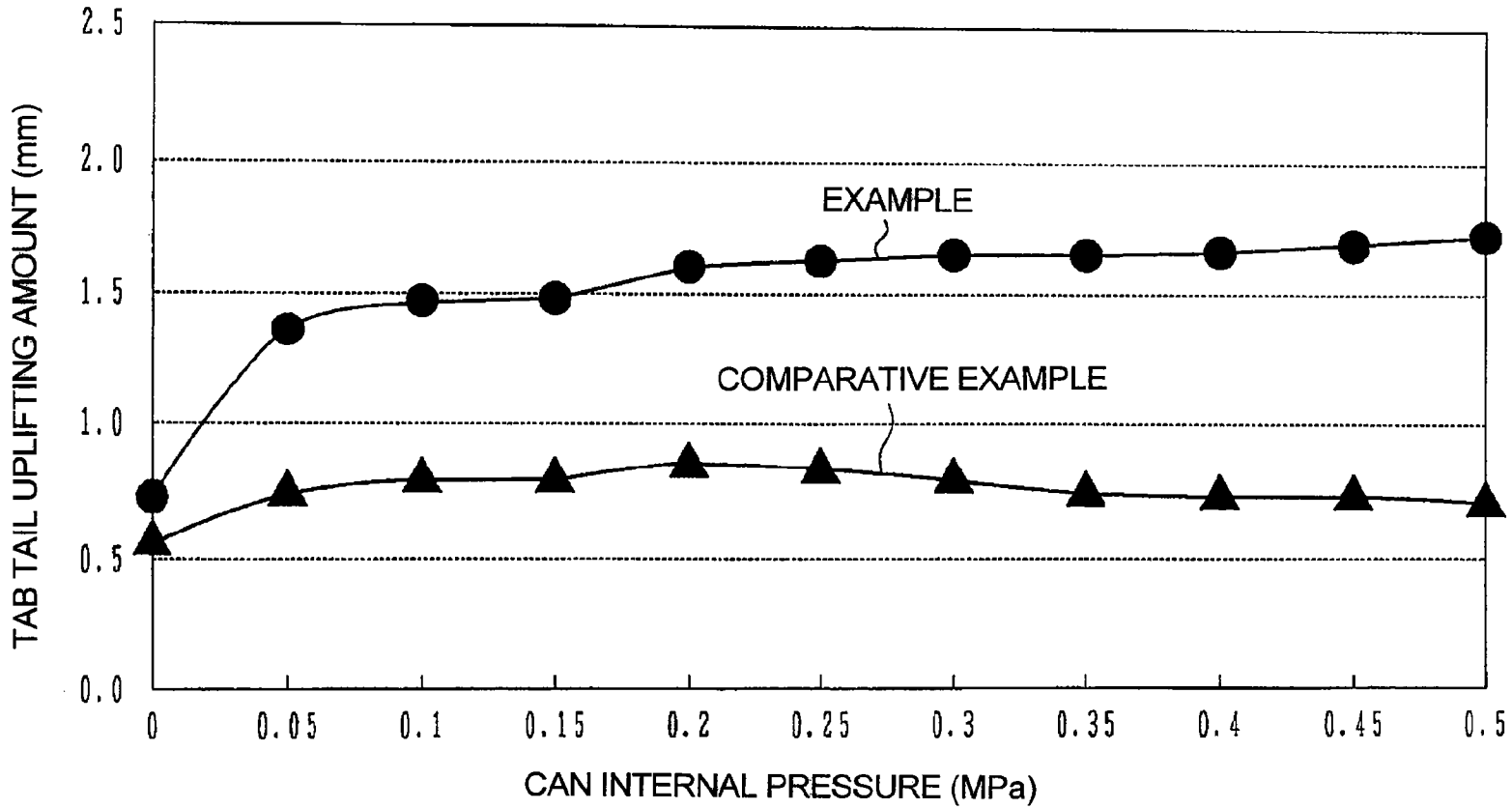
FIG. 9 is a graph illustrating a relationship between a tab tail uplifting amount and a can internal pressure in an example (expressed by a mark "●") and a comparative example (expressed by a mark "▲").

FIG. 9 is a graph illustrating a relationship between the tab tail uplifting amount and the can internal pressure in the example (expressed by a mark "●") and the comparative example (expressed by a mark "▲"). As illustrated in FIG. 9, in the state in which the internal pressure is eliminated, the tab tail uplifting amount of the example is similar to that of the comparative example and the stacking property of the can end is not degraded. In the example, when the can internal pressure is increased, the tab tail uplifting amount is largely increased at the can internal pressure of 0.05 MPa or more, and the finger catching property is significantly improved. On the other hand, in the comparative example, even if the can internal pressure is increased, the tab tail uplifting amount is hardly increased, and the improvement of the finger catching property is hardly recognized compared with the example.

As can be seen from the result, in the example, compared with the comparative example, the finger catching property is significantly improved and the stacking property of the can end is not degraded.

While the present invention has been shown and described with reference to particular embodiments, it will be understood by those skilled in the art that various changes in form and details may be made therein without departing from the spirit and scope of the present invention.

REFERENCE NUMERALS

1: Can end
3: Panel
5: Rivet
7: Pull-tab
9: U-shape notch
11: Outer rim
13: Nose portion
15: Tab tail
17: Score
19: Score panel
21: Finger deboss
23: Inclined surface
S: Pit

The invention claimed is:

1. An easy-open can end for a can comprising: a score that is carved into an opening piece shape in an upper surface of a panel, an opening piece that is surrounded by the score, and a pull-tab that is fixed to a center in the upper surface of the panel with a rivet interposed therebetween, wherein the opening piece is pushed down to open the can while the score is rip-opened by a nose portion of the pull-tab, an inclined surface is formed in a direction of a tab tail of the pull-tab from the center of the panel such that the center of the panel becomes a maximum concave portion of the panel, and is closest to the bottom of the can a lower surface of the pull-tab abuts on or is brought close to the inclined surface along the inclined surface, the pull-tab has a pit in an outer rim, the pit being formed by pressing-down forming, and the pull-tab is bent at the pit;

wherein the outer rim in which the pit is provided has a portion located between two lines tangential to an outer circumference of the rivet and orthogonal to a direction from the rivet toward the tab tail, and the pit is provided in said portion.

2. The easy-open can end according to claim 1, wherein an angle formed between the inclined surface and a horizontal surface ranges from 1° to 3°.

3. The easy-open can end according to claim 1, wherein the maximum concave portion in the center of the panel has a concave displacement amount of 0.1 to 0.5 mm.

4. A method for manufacturing an easy-open can end for a can comprising: a step of carving a score into an opening piece shape in an upper surface of a panel; and a step of fixing a pull-tab to the upper surface of the panel with a rivet interposed therebetween, the rivet being located in center of the panel, wherein part of an outer rim of the pull-tab is pressed down with a wedge-shape press to provide a pit after or at the same time as the step of fixing the pull-tab to the panel;

wherein the outer rim in which the pit is provided has a portion located between two lines tangential to an outer circumference of the rivet and orthogonal to a direction from the rivet toward the tab tail, and the pit is provided in said portion;

wherein, in pressing down with the wedge-shape press, an inclined surface is formed in a direction of a tab tail of the pull-tab from the center of the panel by pushing down the center of the panel such that the center of the panel becomes a maximum concave portion of the panel, and is closest to the bottom of the can and the pull-tab is formed such that the pull-tab is bent at the pit to abut on the inclined surface or to bring a lower surface of the pull-tab close to the inclined surface along the inclined surface.

5. A beverage product with which a can container is filled, the can container being sealed by the easy-open can end according to claim 1.

* * * * *